US005344218A

United States Patent [19]

Weihrauch

[11] Patent Number: 5,344,218

[45] Date of Patent: Sep. 6, 1994

[54] APPARATUS FOR PRODUCING BRISTLE BUNDLES

[75] Inventor: Georg Weihrauch, Wald-Michelbach, Fed. Rep. of Germany

[73] Assignee: Coromet-Werke Heinrich Schlerf GmbH, Wald-Michelbach/Odw., Fed. Rep. of Germany

[21] Appl. No.: 748,070

[22] Filed: Aug. 21, 1991

[30] Foreign Application Priority Data

Aug. 29, 1990 [DE] Fed. Rep. of Germany ..... 4027288

[51] Int. Cl.[5] ..... A46D 1/08

[52] U.S. Cl. ..... 300/2; 300/5; 300/7

[58] Field of Search ..... 300/5, 7, 2

[56] References Cited

U.S. PATENT DOCUMENTS

| | | | |
|---|---|---|---|
| 3,471,202 | 10/1969 | Lewis, Jr. | 300/5 X |
| 3,563,609 | 2/1971 | Lewis, Jr. | 300/7 |
| 3,799,616 | 3/1974 | Lewis, Jr. | 300/2 |
| 4,009,910 | 3/1977 | Lewis, Jr. | 300/5 X |
| 4,693,519 | 9/1987 | Lewis, Jr. | 300/7 |
| 4,696,519 | 9/1987 | Lewis, Jr. | 300/7 |

FOREIGN PATENT DOCUMENTS

| | | | |
|---|---|---|---|
| 2313572 | 10/1973 | Fed. Rep. of Germany | 300/5 |
| 2646048 | 4/1977 | Fed. Rep. of Germany . | |
| 2800146 | 7/1978 | Fed. Rep. of Germany . | |
| 2849510 | 6/1980 | Fed. Rep. of Germany . | |
| 2922877 | 12/1980 | Fed. Rep. of Germany . | |

*Primary Examiner*—Eugenia Jones
*Attorney, Agent, or Firm*—Antonelli, Terry, Stout & Kraus

[57] ABSTRACT

An apparatus for producing bristle bundles has a shaft-like magazine for cut-to-length bristles and at least one tubular bundle gripper, which can be introduced into the magazine and separates a bristle bundle from the bristle supply and which is internally widened from the opening over a short axial length in a continuous curve and then has over most of its axial length an axially parallel wall, accompanied by the formation of a larger internal cross-section than the said opening. The magazine has a vibrating bottom, which "fluidizes" the bristles and vibrating wall portion pushing flush the said bristles.

32 Claims, 7 Drawing Sheets

APPARATUS FOR PRODUCING BRISTLE BUNDLES

FIELD OF THE INVENTION

The invention relates to a process and apparatus for producing bristle bundles with a shaft-like magazine, with the magazine receiving a larger stock or supply of cut-to-length and roughly parallel positioned bristles and with at least one tubular bundle gripper, which has, at an opening end, an internal cross-section corresponding to the desired cross-section of the bristle bundle and which can be introduced into the magazine and separates at least one bristle bundle from the bristle supply.

BACKGROUND OF THE INVENTION

Bristle articles in the present context not only means brushes, brooms, paint brushes, etc. having a conventional construction, i.e., with a handle, grip, etc. and a bristle carrier covered with bristles, but also bristle elements of any type in which, for example, the plastic bristles are joined together at one end by melting to form a bristle strip, the bristle group, etc. For the supply of bristles to the bristle article production station to fundamental process have been proposed. First, the bristle bundle can be supplied in the form of an endless strand and are only cut to the desired length directly at the production station and, optionally, after producing the bristle article. Secondly, it is possible to work with so-called short cuts, for example, prior to the production station, the bristles are cut to the desired length, optionally, with a processing tolerance and then the cut bristle are supplied in bundles to the production station.

When processing cut-to-length bristles, the bristles are placed substantially in parallel in a shaft-like magazine, which normally has two parallel walls spaced with the bristle length. One or more holes are provided in one wall in a lower region of the magazine near the bottom of the magazine whereby it is possible to remove the bristles through the wall in bristle bundles. This function is fulfilled by bundle grippers in the form of small tubes adapted to be introduced through the opening in the magazine. The bundle gripper immersed in the bristle supply and separate a number of bristles from the remaining bristle supply corresponding to the free cross section thereof. The immersion depth of the bundle gripper is generally somewhat less than the bristle length. After extending the bundle gripper out of the magazine, the bristle bundles located in the bundle gripper and projecting outwards therefrom are brought to the production station. Several problems are encountered in this procedure for forming and receiving bristle bundles. When the bundle is inserted in the magazine, the bristles meeting the opening edge of the bundle gripper are displaced outwards at right angles to a movement direction of the bundle gripper or into the bundle gripper or moved axially in front of the gripper. As a result of the first mentioned effect the bundle gripper takes up a different number of bristles, so that the bundles have different densities. In the case of the axial displacement of bristles, the bristles are placed around the opposite magazine wall, then bent down or rolled in with the consequence that when, during the next operation, the bristles are received in a bundle, the bristles lead to a regular projecting length of bristles on the bundle gripper or may even be rendered unusable due to deformations. Attempts have been made to remove these problems in that the bundle grippers are cut in a sloping manner at their opening (DE 28 49 510, DE 29 22 877, U.S. Pat. No. 3,471,202). Thus, with this construction, during the insertion movement, the entire opening edge of the bundle gripper does not enter the bristle supply over its entire circumference and instead successively with partial regions thereof. As the opening edge has a finite thickness, it is not possible to completely eliminate the aforementioned problems. It is disadvantageous that, as a result of the sloping openings, the bristles are mainly displaced to one side and consequently the degree of filling fluctuates considerably. The other, mainly used construction is a bundle gripper with an opening edge, which is at right angles to the bristles in the magazine and the outer wall is conically tapered towards the opening edge, so that the opening edge ideally is a liner edge. This generally restricts the possibility of the bristles being axially displaced through the opening edge (DE 23 35 468, 25 11 611, 26 46 048, 2 00 146, EP 0 149 996, U.S. Pat. No. 3,563,609). Nevertheless, problems of the aforementioned type still occur. Upon removal of the bundle gripper problems can also occur, in that not all the bristles gripped by the bristle bundle gripper remain and instead stick in the magazine due to frictional forces, or are partly drawn out of the bundle gripper. The more particularly applies with respect to the marginal bristles. The reason for this can be a looser filling or the fact that the bristles do not all engage on termination of the bundle gripper facing the opening, for example, the bristles are located with different lengths in the bundle gripper. Attempts have been made to eliminate this problem, inter alia, in that the wall facing the bundle gripper is constructed as a spring-loaded piston which has a cross section corresponding to the bundle and which moves back into the insertion direction during bundle gripper insertion, for example, the bristles grasped by the bundle gripper can escape in the insertion direction relative the bristle supply. In retracting the bundle gripper there is a follow-up by the piston and, consequently, the bristles follow up by the same length in the bundle gripper (U.S. Pat. No. 3,563,609). Quite apart from the fact that such a magazine has a complicated construction, functional disturbances can occur particularly at the transition between the piston and the magazine wall.

According to another possibility (DE 23 35 468), on inserting the bundle gripper the bristles are compressed, in that the gripper is provided on the inside with a constriction, which is either positioned at the central axial length or at the opening. Although this may well be able to render uniform the degree of filling of the bundle gripper it leads to other disadvantages. As a result of the frictional forces between the bristles increase toward the bundle circumference, the bundle gripper is not uniformly filled in depth. There is also a risk that, due to these increased frictional forces the circumferential bristles will project further in the marginal area and will be pushed onto the facing magazine bottom and bent.

Another measure for cleanly cutting the bristles in the bundle for the supply involves providing the bundle gripper externally with deflectors, so that the frictional forces between the cut off bristles and the bristle supply are reduced. (DE 23 35 468). It has also been found that, within the magazine, the bristles should be present with a more uniform looser packing. In order to achieve this bristle-parallel, constructions are provided within the magazine (EP 0 289 687), which take up part of the pressure of the bristle supply above the bundle gripper and ensure a looser backing in the vicinity of said gripper. However, the danger exists that the packing will be completely non-uniform in a vicinity of the bundle gripper. Upon withdrawing the bundle gripper with the cutoff bristle bundles, the bristle adjacent to the gripper can be moved in the removal direction and may possibly be withdrawn from the magazine, thereby leading to problems during the next operation. Therefore, if possible the bristle end should be in one plane at the insertion side. Similar effects occur on inserting the bundle gripper, in that the bristles are moved toward the opposite side. To avoid this it has been proposed in EP 0 289 687, to construct the magazine wall facing the insertion side as an oscillating or vibrating plate which acts substantially axially on the bristle ends and all of the bristle supply in the vicinity of the bundle gripper is compressed on the facing magazine wall. The bristle located in the bundle gripper should be vibrated into the magazine wall. As individual projecting bristles, due to their flexibility, can easily be placed around in front of the other bristle ends during the axial action and, due to the compression on the opposite wall, bristles can also be deformed there, this procedure does not completely obviate the indicated problem.

Finally, any problem occurring the magazine leading to the bristles project into a varying length at the bundle gripper or to a fluctuating degree of filling, can also have a disadvantageous effect in the subsequent production of the bristle articles. This more particularly applies if the bristles are joined to the bristle carrier or shaped into a bristle element by a thermal process, such as welding, melting, injecting, etc.

SUMMARY OF THE INVENTION

The aim underlying the present invention resides in further developing the aforementioned apparatus so that a uniform degree of filling is achieved in the bundle gripper and also on insertion into the magazine and on removal of the bundle gripper, the bristles adjacent thereto are not influenced. In addition, a process is to be provided enabling the bundles, grasped by the bundle gripper, to be processed to completely satisfactory bristle articles.

In accordance with the present invention, the bundle gripper is internally widened over a short axial length from the opening end, following onto the same, has over most of its axial length an axially parallel wall, accompanied by the formation of an internal cross section greater than the opening.

The invention is based on the finding that, on inserting the bundle gripper into the magazine, there should neither be a thinning nor a thickening of the bristle pack, so as to avoid fluctuating friction conditions over the bundle cross-section and in the immediate vicinity thereto in the bristle supply. Thus, use is made of a bundle gripper, whose cross-section at the opening corresponds to the desired bristle bundle cross section, for example, so as not to compress the bristle taken up. Upon initial introduction of the bundle gripper, the number of bristles loosely filling the desired cross-section is separated by the bristle supply. During further introduction of the bundle gripper, as a result of the widening cross-section, the bristles are able to expand, so that, over most of the axial length of the bundle gripper, no forces are exerted on the bristles and, consequently, no uncontrolled frictional forces can act between the bristles. In other words the cross section of the opening, in conjunction with the packing density of the bristles in the magazine, determine the number of bristles per bundle. During further insertion, no external forces act on the bristles received in this manner. In conjunction with an approximately linear opening edge, the further advantage is obtained that no forces can act on the bristles remaining in the magazine immediately adjacent to the bundle gripper and, in particular, not those which could lead to an axial displacement of the bristles.

A preferred embodiment is characterized in that the bundle gripper has, on the inside thereof, an axially parallel wall extending over a short axial length from the opening and to which is connected the continuous curve widening cross-section.

The bundle gripper can fundamentally have any cross-sectional shape, for example, circular, oval, polygonal, etc. The continuous curve leading to the widening from the opening can be straight or a convex curve. In the first case, to the short axially parallel separation portion is connected a conically widening portion and to the conically widening portion an axially parallel wall portion over most of the axial length.

In accordance with further features of the invention, the bundle gripper is provided with an internal wall extending axially parallel over the entire length and, within the bundle gripper and along the axis thereof is provided an mandrel, which over a short length in the vicinity of the bundle gripper opening has a thickened portion with an axially parallel contour and a taper on the free end projecting over the gripper.

By virtue of the last mentioned features of the invention, a hollow bundle is obtained, and it is ensured that the bristles are not compressed upon insertion of the bundle gripper. Firstly, the mandrel with its leading taper enters the bristle supply and outwardly displaces the bristles and the packing density of the bristles within the magazine is not or is only insignificantly influenced. Only those bristles which can freely enter the annular space between the opening and the thickened portion of the mandrel pass in loosely packed form into the bundle gripper and can radially expand and loosen after the thickened portion.

As has been indicated above, externally positioned deflectors are known (DE 23 35 468), but such deflectors are only effective after a certain insertion depth. The invention proposes that the bundle gripper is externally provided immediately following onto the opening with a deflector for the bristles in the magazine adjacent to the separated or cutoff bristle bundle, in that the outer wall, including the taper, travels in a continuous curve to a maximum wall-cross-section, which then decreases again and, following this, extends axially parallel over most of the length. The bristles adjacent to those to be separated from the supply are consequently increasingly and continuously displaced outwardly at the start of the bundle gripper insertion process and can no longer have a force influence on the separating or cutting process, particularly with respect to the bristles located externally of the bundle. As a result of the deflector effect at the start of the insertion process, it is possible to ensure that the bristles adjacent to the cut-off bundle are not subject to an axial action leading to the displacement.

In accordance with still further features of the present invention, the bundle gripper is rotated about its axis and, as a result of the uniform, intermittent or oscillating rotary movement, radial forces act between the bundle gripper, which assists the loosening of the bristles when the gripper is inserted in the magazine and reduce the frictional forces between them. This makes the degree of filling more uniform and reduces the axial forces acting on the bristles close to the bundle gripper which lead to an axial displacement of the bristles.

According to the invention, over a short length in a vicinity of the opening, the bundle gripper is externally provided with a profile oriented in the axial direction. The profile is preferably formed by troughs arranged equidistantly on the gripper circumference. As a result, the radial deflection forces are increased on inserting the bundle gripper and act to a varying extent on the individual bristles surrounding the bundle gripper in the magazine.

Advantageously, the construction is such that the troughs have a pitch circular cross-section. The troughs can be constructed in such a manner that they open out at the edge of the circular opening. A preferred embodiment is characterized in that the bottom of the trough is located on a conical surface tapering towards the opening. Transferred to the previously described embodiment, this means that the conical surface opens out at the edge of the opening, for example, is located in a plane at right angles to the bundle gripper axis. In accordance with additional features of the present invention, the conical surface on which is located the trough bottom, passes through the cylindrical surface formed by the opening, so that the edge or rim of the latter has a crown-like construction. By virtue of the last-mentioned features of the present invention, the entire circumference of the opening edge does not simultaneously meet the ends of the bristles in the magazine and instead the process is time "extended", namely to that time required by the bundle gripper for covering the path corresponding the axial depth of the crown-like profile of the opening edge.

Advantageously, according to the present invention, the termination of the bundle gripper facing the opening has narrow channels which are connected to a vacuum source. The vacuum action on the bristles at their rear ends in the bundle gripper is similar to that described in DE 28 49 510. However, it can only inadequately fulfill its function in the latter, because the bundle gripper is cut in a sloping manner at its opening with the consequence being that, during the insertion process, an increasingly narrowing free cross-section remains open and, as a result of the vacuum, there is an air flow with a constantly increasing flow speed during the insertion process, which can lead to the bristles entering the gripper last being drawn into the gripper before the remaining grippers, that is, a final uniform bristle projection on the bundle gripper is not ensured.

The bristle bundle taken up by the bundle gripper must be transferred to the production station. This can be brought about in that the bundle gripper simultaneously serves as a transporting or conveying means so as to directly transfer the bundles to the production station and the fixing of the bundle at the bristle carrier takes place when the bundle are still in the gripper (DE 26 46 048, DE 23 35 368).

In another known construction (EP 0 149 996, DE 28 08 966), within the bundle gripper is provided a piston forming its termination for ejecting the bristle bundles, with the bundle gripper having a constant cross-section over its entire length. In the construction according to the invention, the piston has a cross-section corresponding to the largest internal cross-section of the bundle gripper and within the latter its wall is displaceable in closely engaging manner at the most up to the shoulder of the continuous curve leading to the opening.

As is known from DE 23 35 468, for the formation of hollow bundles, a mandrel is arranged in the bundle gripper axis and is used for the aforementioned of cross-section formation. In this case, the piston is guided on the mandrel, so that also, in the case of a hollow bundle, the latter can be moved out of the bundle gripper.

For further reducing the forces acting on the bristles during the insertion of the bundle gripper, the bundle gripper and the mandrel are smooth-walled on all surfaces coming into contact with the bristles, with the surfaces being, for example, polished or coated With a sliding material.

As is also known, the bundle gripper can also serve as a mounting support for the bristle bundles during the further processing thereof and optionally also as a conveying means to the production station.

In addition, in DE 28 49 510, an apparatus is proposed wherein at least one guide channel is provided, in which the bristle bundle is held during the production of the bristle articles. The bristle bundle taken up by the bundle gripper is transferred to the guide channel to be processed at the production station. According to the invention, such an apparatus is characterized in that the bundle gripper, introduced from one side into the magazine with the bristle bundle separated from it, remains in the inserted position and, by the piston, the bristle bundle can be moved to the opposite side of the magazine into the guide channel of the guide located there.

In this construction, according to the invention, the bristle bundle separated from the bristle supply is only moved in one direction, namely, the insertion direction. The bundle gripper with the taken up bristle bundle moves out on the magazine side opposite to the insertion side. Thus, there is no retraction of the bristle bundle and the functional problems associated therewith are avoided (carrying along of bundles from the bristle supply, sticking of bristles of the bundle, etc.). The bundle always moves in the same direction when the transfer takes place by the piston at the production station.

Advantageously, the guide is constructed as a mounting support for the bristle bundle and the bristle bundle can be fixed in the guide. The bristle bundle, transferred to the guide by the bundle gripper, is also fixed in the guide, so that the bristle bundle can be brought into or fixed in a reproducible production position. For example, for this purpose, the guide may have a clamping device constricting the guide channel cross-section and fixing the bristle bundle. Another advantageous construction is characterized in that the guide or a further guide has a plurality of guidance channels, which are arranged in an angular manner to one another at least in the vicinity of the bristle exit end and in which the bristle bundles can be deflected during transfer into a position corresponding to the desired position on the bristle article.

In this embodiment, the bundles from the bundle gripper can be directly introduced by the piston into the guidance channels at the production station and can be deflected from their original axis, at least in the vicinity of their fastening-side end. Therefore, the bundles can be brought into a random angular position relative to one another and/or to the bristle carrier.

In another construction of the present invention, in the case of a plurality of bundle grippers, the pistons may have different end positions in the grippers and may insert the bundles by a correspondingly varying amount into the guidance channels, in order to obtain varyingly long bristle bundles on the bristle article. In this embodiment, the bundle ends, project into a varying extent over the guide channels, may be cut off in a common plane, so that in the guide channels and, optionally, the bundle grippers, bundle of different length are obtained, which are then connected at the cut end to the bristle carrier. This allows random contouring of the use-side envelope of the bristle ends.

The two aforementioned embodiments may be combined with one another in that the bristle bundles can be inserted by a varying amount by the piston into a first guide, accompanied by the formation of a projecting length at the opposite side, and the projecting lengths are cut off and, upstream of the cutting point, a further guide may be inserted having guide channels inclined with respect to one another on the opposite side and into which the bristle bundles may be slide.

Thus, with an apparatus of the aforementioned type at the same time the bundle length and bundle position can be varied. It is advantageous in both cases if the bristle bundles can be slid with their ends facing the pistons through the guidance channels and fixed by the projecting ends to a bristle carrier.

It can also be provided in the aforementioned embodiments, that following the insertion of the bundle gripper into the magazine and prior to the sliding out of the bristle bundle by the piston,. the guide or mounting support with the guidance channel can be introduced in front of the bundle gripper opening.

A further design possibility includes providing the leading face of the piston having a contour differing from the plane for contouring the bristle bundle ends. In this manner, the bristles within a bundle can be contoured at the use-side end in concave, convex or some other way, so that, in conjunction with the aforementioned embodiments, the inventively constructed apparatus can be used for producing random contours on the useful surface of a brush.

As has already been indicated, for a completely satisfactory trouble free removal of the bristles or for the formation of bundle having a same number of bristles, importance is attached to the bristle packing density within the magazine, which, in particular, must not be too high. Thus, according to the invention, the bottom terminating the lower end of the magazine is constructed as an oscillating or vibrating bottom, which can be given an oscillating or vibrating movement loosening the bristle supply or part thereof.

As a result of the inventive construction, the static friction or forces of the attraction due to the electrostatic charging between the individual bristles is largely eliminated and, much in the same manner as is known in connection with the storage of free-flowing materials at the same time the bristles are fluidized. This leads to a relatively loose packing of the bristle within the magazine, so that, upon inserting the bundle gripper, the risk of axial displacement of the bristles is considerably reduced and in particular the bristles can be moved to the side substantially free form forces. This increases significantly the probability of the same number of bristles in each bundle.

Whereas, in the case of the known apparatuses a knocking or vibrating plate is provided for straightening the bristle ends resulting the aforementioned difficulties, according to the invention, the vibratable wall portion is positioned parallel to a facing magazine wall and at a distance therefrom which, in any vibration position, is only slightly larger than the length of the bristles in the magazine.

This construction ensures that the vibrating wall portion only acts axially on those bristles which, e.g. on inserting the bundle gripper, project over the bristle ends which are otherwise in one plane. It is, in particular, avoided that the bristles are compressed against the facing magazine wall, because the shortest distance between the fixed wall and the vibrating wall portion is always larger than the bristle length.

The aforementioned requirement can be appropriately satisfied in that the vibratable wall portion has associated therewith adjustable stops for maintaining the distance with respect to the facing wall.

For rendering the bristle packing within the magazine, at least in the vicinity of the bundle gripper while also ensuring the fluidized state of the bristles, according to the invention, a separating device is provided which can be introduced into the magazine at right angles to the bristles and above the bundle gripper and can receive the weight of the bristle supply located above the gripper.

The separator is inserted immediately following the extension of the bundle gripper and the subsequent sliding of the bristles into the magazine, so that only the bristles located below the separator are subject to the vibration of the magazine bottom and clearly define conditions with respect to the bristle packing need only be produced in the vicinity of the bundle gripper.

The aforementioned effects can be further assisted in that the separator, in the inserted position, can be raised at least during the insertion of the bundle gripper into the magazine.

In this embodiment the bristle supply located in the vicinity of the bundle gripper is loadwise completely separated from the bristle supply above it, at least during the removal process.

The inventive apparatus makes it possible to produce bristle articles in a particularly simply manner and with a high quality.

If, as conventional, the bristle bundles are melted at one end in the vicinity of the bundle gripper opening and brought together with an at least zonally melted bristle carrier, then this process can be improved by the inventive apparatus in that the further bundles are pushed flush with the gripper opening and melted into the gripper and, upon bringing together the bristle bundles and the bristle carrier, the bundle gripper is placed tightly on the carrier and the bristle bundle is pressed by the piston.

In this process is it ensured that the melting area of the bristles is limited to the cross-section of the bundle gripper, and, for example, the melt cannot escape laterally. On bringing together with the bristle carrier at the junction point, the formation of beads or the like by displaced melt material is avoided.

This process can be further optimized in that the bundle gripper with its opening, enclosing the melt of the bristle bundle and the bristle carrier, is tightly placed on the bristle carrier.

This ensures that also the melt material on the bristle carrier is not trapped and cannot escape to the side. This leads to a cleaner bundle connection to the bristle carrier. In addition, the material to be melted can be reduced to a minimum.

From the process standpoint, the use of the inventive apparatus makes it possible to form on the bristle carrier a preshaped depression with at least one projection projecting from the bottom of the depression, that the bristle bundle pushed flush with the bundle gripper opening and into the gripper is melted accompanied by the formation of a depression and that near to the surface of the projection is melted in the depression and the bundle with its melted depression is pressed by the piston into the depression onto the projection.

In this embodiment the melt or melt connection of the bristle bundle and bristle carrier is displaced into the bristle carrier, so that in this way a cleaner bundle termination is obtained at the bristle carrier while at the same time there is an adequate bundle fastening length thereto.

It has also been found in the conventional apparatus that the bristles are frequently split at the bundle gripper insertion side due to the leading opening edge of the gripper. The more particularly occurs if, as is desired, the opening edge is in the form of an approximately linear edge. This splitting of individual bristles can be inventively avoided in that the cut-to-length bristles are deburred at least at one of their ends and placed in the magazine facing the bundle gripper with the deburred end.

On cutting the bristles to the desired length, as a function of the nature of the plastic material and the cutting tool used, burrs having a different extension are formed at the cutting point. They are clearly responsible for the splitting of individual bristles on inserting the bundle gripper. Such splitting is effectively avoided by the preceding deburring according to the invention.

In conjunction with the inventive process it is also advantageous if the cut-to-length bristles, at least at one end, which will subsequently be the use-side end are worked and placed in the magazine with the worked ends oriented to one side.

Whereas, as a rule, the bristles are only worked, for example, rounded after fixing to the bristle carrier, according to the invention, this working takes place prior to placing of the bristles in the magazine. Such a working operation is described in German application P 40 06 325. Compared with the proposed process, it leads to a more uniform working of the bristle ends. This process can be combined with the aforementioned process in that a separate deburring can be obviated, in that the bristles are so placed in the magazine that their worked ends are located at the bundle gripper insertion side. This avoids a separate deburring and a use-favorable final working of the bristles can be utilized during bundle formation in order to prevent splitting of the bristles.

BRIEF DESCRIPTION OF THE DRAWINGS

The above and other objects, features, and advantages of the present invention will become more apparent from the following description when taken in connection with the accompanying drawings which show, for the purpose of illustration only, several embodiments in accordance with the present invention, and wherein:

FIGS. 12*a*–12*f* are exploded schematic views of an apparatus constructed in accordance with the present invention for producing bristle articles in different operating states;

DETAILED DESCRIPTION

Figure 1:
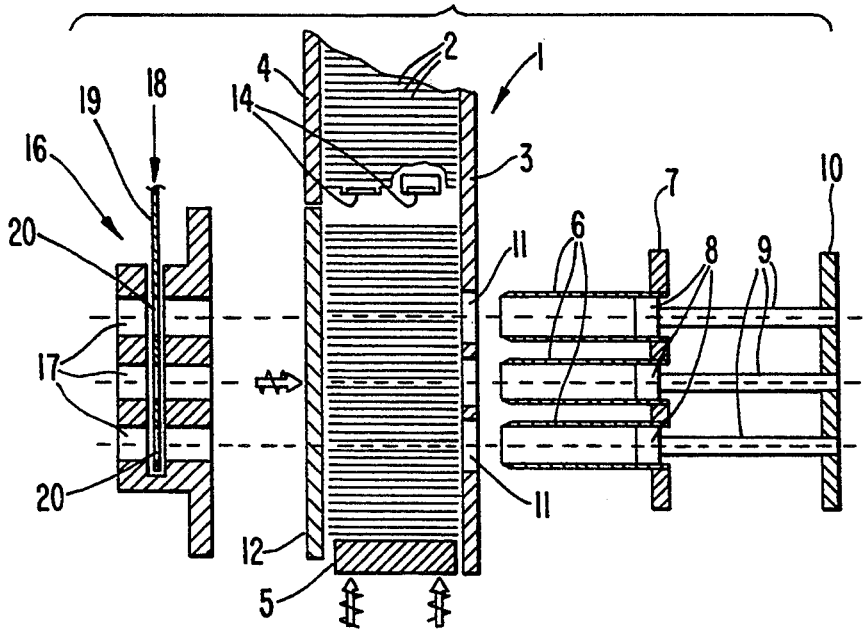
FIG. 1 is an exploded schematic side view of an apparatus for producing and transferring bristle bundles.

FIG. 1 illustrates a lower part of a magazine generally designated by the reference numeral 1 for cut-to-length bristles 2, which are placed in parallel in the magazine 1, with the magazine 1 having a shaft-like construction with parallel walls 3, 4 and a bottom member 5. The spacing of the walls 3, 4 is slightly greater than the length of the bristles 2, and the magazine 1 is filled from the top, with the weight of the introduced bristles 2 being received or carried by the bottom member 5. On one side of the magazine 1 associated with the wall 3, is positioned a group of bundle grippers 6, which are located on a movable support 7. The bundle grippers 6 are tubular, e.g. cylindrical, but may have any other random cross-sectional shape. The rear termination of the bundle gripper 6 is in each case formed by a piston 8, with the respective pistons 8 being carried by a piston rod 9 on a piston carrier 10 which, together with the support 7 of the bundle gripper 6, can be moved in the axial direction indicated by the broken lines, but is also movable relative to the support 7, so that the respective pistons 8 can be inserted in to the respective bundle gripper 6.

The bundle gripper 6 can be moved up to the magazine 1 together with the support 7 and the carrier 10. The wall 3 of the magazine 1 has openings 11, whose cross-section corresponds to the external cross-section of the bundle gripper 6. The bundle gripper 6 can be introduced into the magazine 1 through said openings 11. Each bundle gripper 6 separates a bundle-forming member of bristles 2 from the supply in the magazine 1 and are taken up during the gripper insertion movement.

In the vicinity of the bundle gripper 6, the opposite wall of the magazine 1 has a wall portion 12, which can be vibrated or oscillated in the bristle extension direction. The wall portion 12 serves to move the bristles 2 in the working area of the bundle gripper 6 towards the wall 3, so that they are pushed flush at the end facing the wall portion 12. The wall portion 12 is arranged in such a manner that, in any vibrating position, the wall portion 12 has a spacing with respect to the facing wall 3 which is slightly greater than the bristle length. The spacing may be achieved by, for example, the limiting stops 13 (FIG. 2).

As is schematically illustrated, the bottom member 5 of the magazine 1 can be vibrated, with the vibration direction being substantially vertical. The incorporated bristles are jolted in, in order to achieve a uniform packing density. In conjunction with the subsequently described detail of the apparatus, the bristles 2 are "fluidized" in a type of vibrating state by the bottom member 5.

Figure 2:
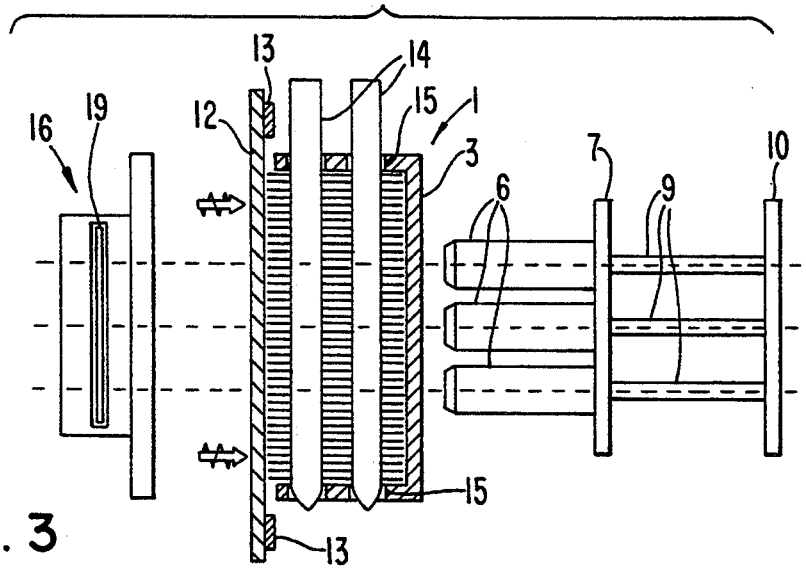
FIG. 2 is an exploded plan view of the apparatus of FIG. 1.

Above the working area of the bundle gripper 6 are located separators 14 which, as shown in FIG. 2, are constructed as narrow lances and can be introduced in aligned openings 15 in the facing end walls of the magazine 1. They receive the weight of the bristle supply located above the working area of the bundle gripper 6. In order to ensure that the loosening effect by the vibrating bottom member 5 acts fully on the bristles in the working area of the bundle gripper 6, the separators 14 can also be raised and lowered. Prior to each operating stroke of the bundle gripper 6, for example, substantially in the operating state shown in FIG. 1, the separators 14 are inserted and raised. The separators remain in this position at least until the bundle grippers 6 have completed their operating stroke. The separators are then extended, so that, after the extension of the bundle grippers 6, the bristles 2 can subsequently slide out of the upper region of the magazine 1.

In the side facing the bundle grippers 6, is provided a guide generally designated by the reference numeral 16 with parallel guidance channels 17, which are aligned with the grippers 6 on the opposite side. With the guide 16 is also associated a device generally designated by the reference numeral 18, which in the illustrated embodiment is constructed as a clamping device. The clamping device 18 comprises a plate-like slide 19, which has openings 20, whose cross-section substantially corresponds to the guidance channels 17 or the internal cross-section of the bundle grippers 6. The slide 19 is displaceable at right angles to the axis of the guidance channel 17, so that the openings 20 can be brought into a position displaced with respect to the channel 17.

Figure 3:
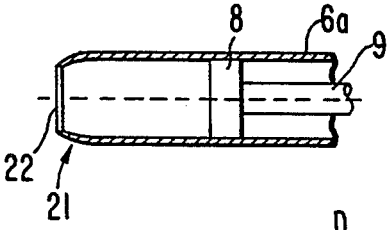
FIG. 3 is an axial cross-sectional view, on an enlarged scale, of a bundle gripper constructed in accordance with the present invention.

In operation, in the starting position shown in FIG. 1, in which the separators 14 receive the bristles 2 in the upper area of the magazine 1 and both the bottom member 8 and the wall portion 12 are vibrated, the bundle grippers 6 are introduced by the support 7 through the magazine openings 11 thereby separating a plurality of bristles 2 from the bristle supply so as to, in each case, form a bundle of bristles 2. If the bundle grippers 6 have reached their end position, in which, for example, the support 7 runs up against the side wall 3 of the magazine 1, the wall portion 12 is moved out laterally, the guide 16 is moved up to the then exposed ends of the bristles 2, so that the bundle grippers 6 with their front ends roughly engage on the facing end wall of the guide 16. The bristle bundles located in the bundle grippers 6 are then slide out of the bundle grippers 6 by the piston 8 by movement of the piston carrier 10 and are introduced into the guidance channels 17 of the guides 16. The slide 19 is then moved out of the position shown in FIG. 1 at right angles to the guidance channels 17, so that the bristle bundles located in the guidance channels 17 are fixed. The bundle gripper is then moved back with the piston 8 into the starting position shown in FIG. 1. Towards the end of the insertion movement of the bundle grippers 6, the lance-like separators 14 can be drawn out of the magazine 1, so that the bristles 2 slide. Following the transfer of the bundles, the guide 16 moves into the position shown in FIG. 1 and the wall portion 12 again moves into its position completing the wall 4. The bristles 2 in the working area of the bundle grippers 6 are again pushed flush by means of the vibrating wall portion 12. In the bundle gripper 6*a* of FIGS. 3 and 4, a front end generally designated by the reference numeral 21 with which the bundle grippers 6*a* are introduced into the magazine includes an outer wall which is drawn inward, accompanied by the reduction of the wall thickness, preferably, in such a manner, that the opening 22 has an approximately linear opening edge, and is more clearly shown in FIG. 4. The free cross section of the bundle gripper 6*a* in the vicinity of the opening 22 determines the cross-section of the received bundle 6 in a packing density, as in the lower region of the magazine 1. In the illustrated embodiment, the bundle gripper 6*a* has a cross-section A over a short axial length C. The inner wall of the bundle gripper 6*a* diverges from the cross-section A over a comparatively short axial length D in a continuous curve and possibly a straight line, back to a larger internal cross-section B. The bundle gripper 6*a* has the larger internal cross-section B over most of its axial length, as shown in FIG. 3.

Figure 5:
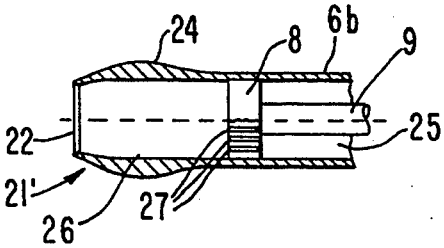
FIG. 5 is an axial cross-sectional view of another embodiment of a bundle gripper constructed in accordance with the present invention.

In the bundle gripper 6*b* of FIG. 5, a front end 21 is provided with a deflector 24, which is obtained by an exclusively external enlargement of the wall thickness. Thus, at the outside the deflector forms a thickened portion, which is axially formed by a continuous curve and which is attached to the opening 22 and extends over a short axial length and subsequently passes back into the smaller external diameter of the bundle gripper 6*b*. In addition, in the embodiment of FIG. 5, the bundle gripper 6*h* is connected to a vacuum at the space 25 located behind the piston 8. So that the vacuum also acts in the space 26 receiving the bundle, the piston 8 is provided with a plurality of very small diameter bores 27. The diameter is in particular smaller than that of the bristles. The vacuum in the space 25 assists the reception of the bristles in the space 26. It is possible to precede in such a manner that the piston 8 is moved forwards in the starting position (FIG. 1) and moves back in accordance with the insertion speed of the bundle gripper 6*d*, so that all the bristles separated by the latter are suctioned into a supporting manner.

In a modification of the apparatus of FIGS. 1 and 2, a front face 28 of a piston 8' is spherically curved, so that the bundle 29 received by the bundle gripper 6*c* is contoured at the end facing the face 28 of the piston 8' in that on sliding out of the gripper 6*c* the bundle 29, the bristles 2 within the bundle are moved axially to one another. In addition, the pistons 8 can be located on piston rods 9 of different lengths as, for example, the piston 8' in FIG. 6 or can perform strokes of differing lengths, so that on transferring the bundles 29 from the bundle gripper 6*c* at the guide 16 the bundles are contoured at their ends, for example, the ends rest on a spherical surface, while on transferring to the guidance channels 17 of the guides 16 the bundles 29 project a varying amount over the guide 16, so that the envelope of all of the bundles of a bristle coverage can be contoured.

Figure 6:
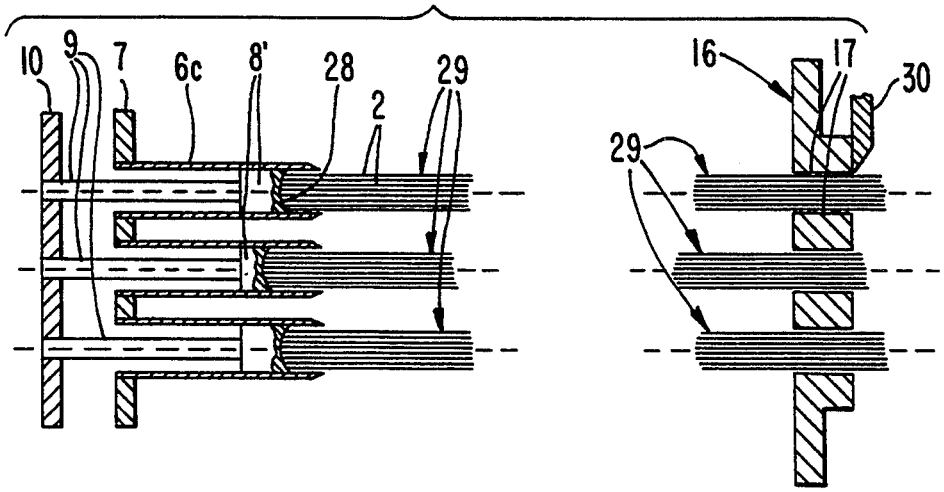
FIG. 6 is an exploded detailed view of an apparatus similar to the apparatus of FIG. 1.
Figure 7:
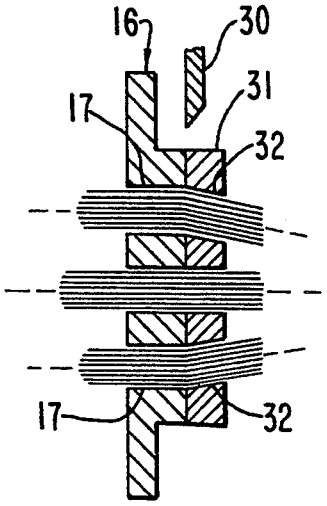
FIG. 7 is a cross-sectional view of a part of the apparatus of FIG. 6.
Figure 8:
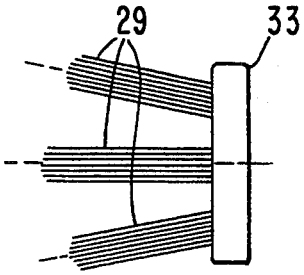
FIG. 8 is a schematic view of a portion of a brush produced with the apparatus of FIGS. 6 and 7.

In the illustrated embodiment of FIG. 6, the bundles 29 at their ends projecting over the guide 16 at the opposite side are cut flush by a cutting mechanism 30. This provides a further possibility after extending the cutting mechanism 30 to insert before the guide 16 a further guide 31 (FIG. 7) whose guidance channels are not or only are partly in alignment with the guidance channels in the guide 16. As apparent from FIG. 7, the outer channels 32 can, in particular, be at an angle to the guidance channels 17. By pushing on the bundles from the left-hand side in FIG. 7, the bundles at the opposite end can at least partly be deflected into an angular position. In this position, they can be fixed to a bristle carrier 33 (FIG. 8), so that the bristle coverage shown there is obtained, in which the bundles 29 are at an angle to one another, with the end of each bundle being contoured and the ends of all bundles are once again in a contoured envelope.

Figure 9:
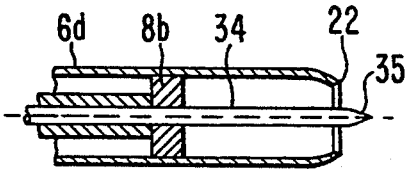
FIG. 9 is an axial cross-sectional view of another embodiment of a bundle gripper constructed in accordance with the present invention.
Figure 10:
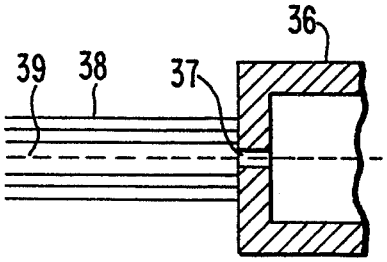
FIG. 10, is a partial sectional view of a bristle article produced with the bundle gripper of FIG. 9.

In a bundle gripper 6*d* of FIG. 9 used for producing bundles with a bristle-free axial channel, a mandrel 24 is located along a longitudinal center axis of the bundle gripper 6*d*, with the mandrel 34 being tapered at a free end projecting through the opening 22 to form a rounded tip 35, and with the mandrel 34 being guided by a piston 8*d*. On inserting this bundle gripper 6*d* into the bristle supply, the bristles are displaced outwardly or away from the center thereof by the mandrel 34, so that a hollow bundle is obtained. Such bristle bundles are, for example, required for applicators, as is schematically illustrated in FIG. 10. Such an applicator 36 has at least one channel 37 through which the medium can pass out of the applicator. The applicator 36 is provided with a bundle 38, which was produced with a bundle gripper 6 according to FIG. 9 and the center has a channel 39 which, for example, extends the applicator channel 37.

Figure 4:
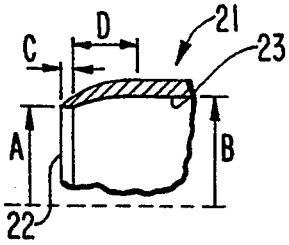
FIG. 4 is a partial cross-sectional view, on an enlarged scale, of a portion of a front end of the bundle gripper of FIG. 3.
Figure 11:
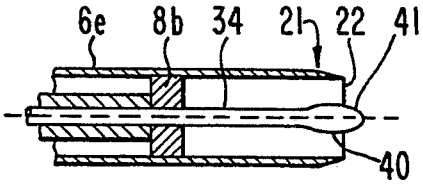
FIG. 11 is an axial cross-sectional view through a further embodiment of a bundle gripper constructed in accordance with the present invention.
Figure 12A:
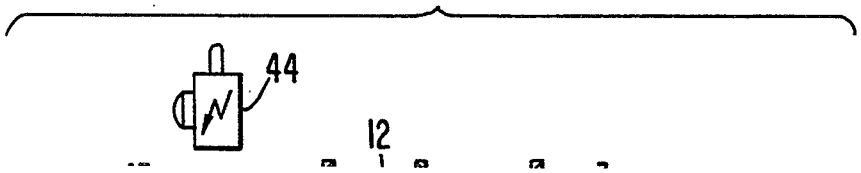
Figure 12A:
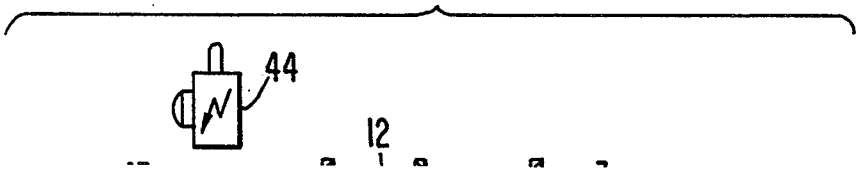
Figure 12A:
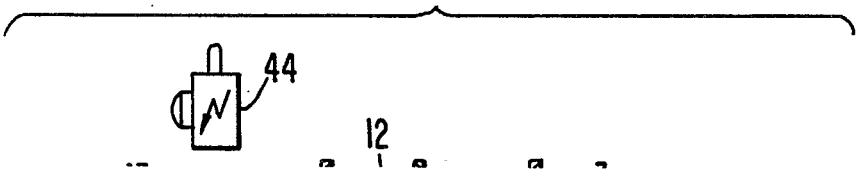
Figure 12A:
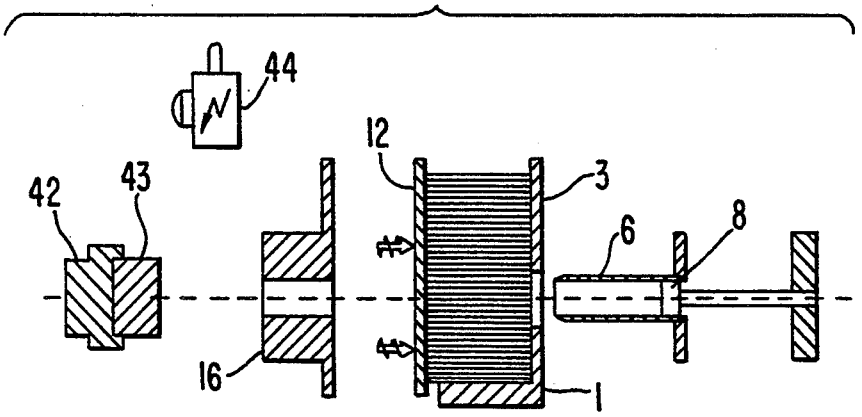
Figure 12B:
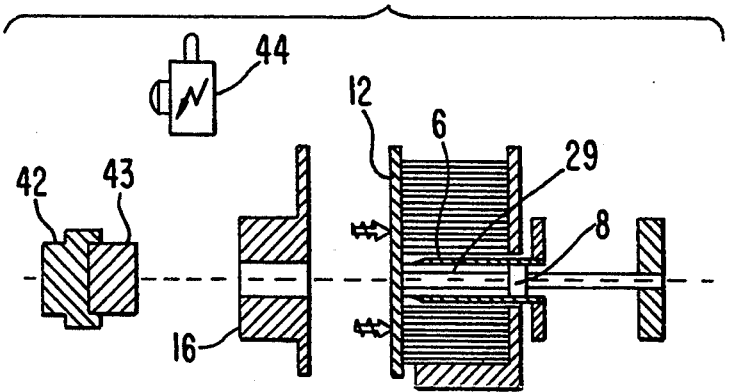
Figure 12D:
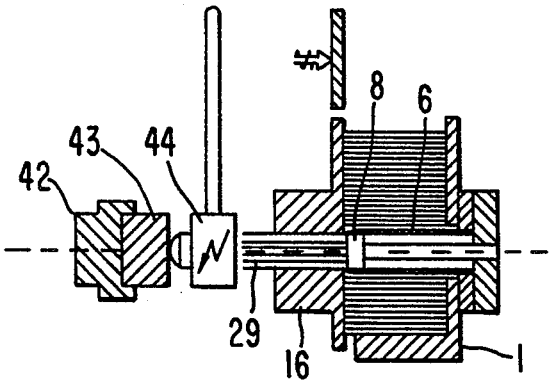
Figure 12E:
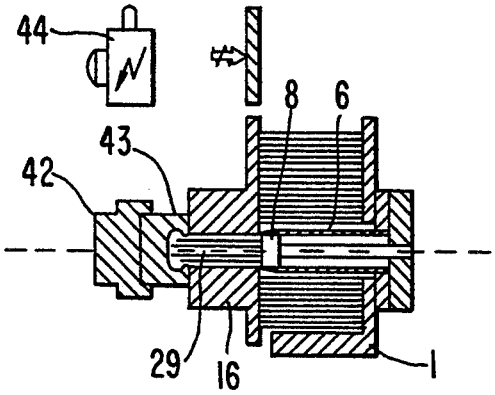
Figure 12F:
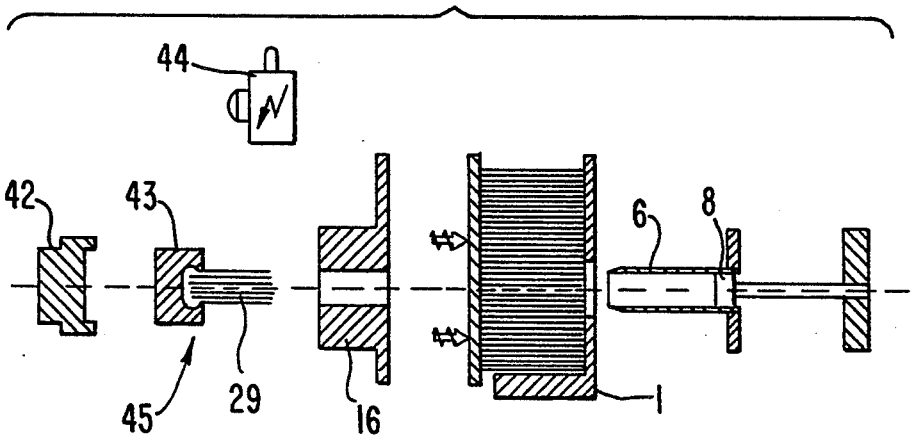
Figure 13A:
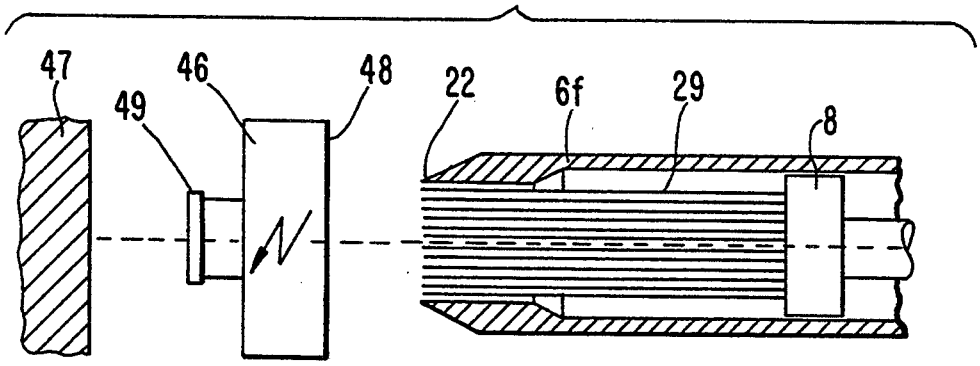
FIGS. 13*a*–13*d* are partial schematic views of another embodiment of an apparatus constructed in accordance with the present invention similar to FIGS. 12*a*–12*f* in different operating states.
Figure 13B:
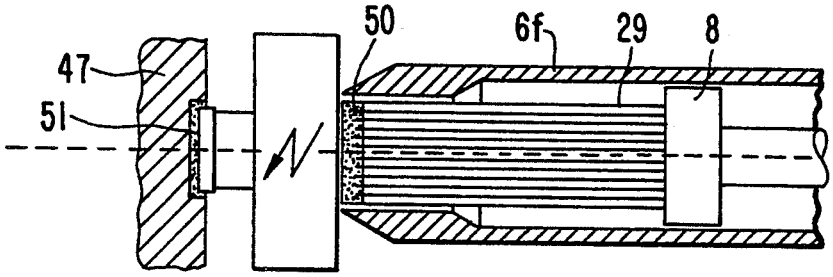
Figure 13C:
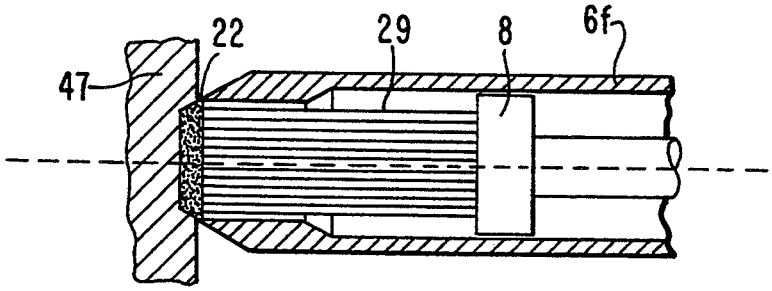
Figure 13D:
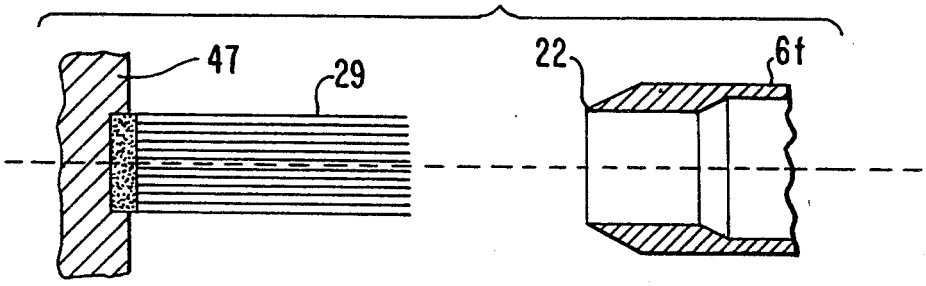

In FIG. 11, the bundle gripper 6*e* embodiment modified as compared with FIGS. 3 and 4 and useable in the manner of the embodiment according to FIG. 9 as the narrowest cross-section in the vicinity of the opening 22 (section C in FIG. 4) by virtue of the fact that the gripper 6*e* is internally provided with an axially parallel wall over the entire axial length. A mandrel 34 is disposed in the bundle gripper 6*e* which is provided at its front end with a thickened portion 40 having an axially parallel contour. In the area projecting over the bundle gripper 6*e*, the mandrel 34 once again tapers to a rounded tip 41. This ensures that upon inserting the bundle gripper 6*e* into the bristle supply, the bristles are initially displaced outwardly and only the ends of the bristles in the vicinity of the opening 22 are grasped by the bundle gripper 6*e* without any bristle compression taking place.

FIG. 12 diagrammatically shows the sequence when producing e.g. a brush or the like. The components described in conjunction with FIG. 1 are present and have the same reference numerals. Additionally on the side of the guide 16 facing the magazine 1 it is possible to see a holder 42, which receives a bristle carrier 43. A heater 44 is also shown, which may be inserted between the guide 16 and the bristle carrier 43 to which the bristle bundles are to be fixed. With the piston 8 retracted, the bundle gripper 8 moves into the magazine 1, separates a bundle 29 from the bristle supply (FIG. 12*b*) and after moving back the vibratable wall portion 12, the guide 16 moves up to the exposed ends of the bristles. The piston 8 is moved into the bundle gripper 6 and slides the bristle bundle 29 on the opposite side of the magazine 1 into the guide channel 17, the bundle 29 projecting over the opposite side of the guide 16 (FIG. 12*c*). The heater 44 is then moved in front of the free end of the bristle bundle 29 and, at the same time, the bristle carrier 43 with the holder 42 is moved up to the heater 44. The bundle 29 is melted at its end and the bristle carrier 43 at the side facing the heater 44 and, for example, a thickened portion is formed at the bundle end. After removing the heater 44 and moving up the bristle carrier 43, the bundle end penetrates the mouth of the carrier 43 (FIG. 12*e*). After brief cooling, the components the apparatus are moved apart, as shown in FIG. 12*f*. The finished brush can then be removed.

In the embodiment according to FIG. 13, a bundle gripper 6*f* with a piston 8 is provided with the gripper 6*f* tapering towards the opening 22 in the manner similar to FIG. 3. A heater 46 and a bristle carrier 47 are shown in detail form. In this embodiment the bundle gripper 6*f* is used for directly producing bristle articles. Thus, compared with the embodiment of FIGS. 1, 2 and 12, the apparatus requires no guide 16. The heater 46 has, on the side facing the bundle gripper 6*f*, a heating reflector 48 and, on the remote side, a heating piston 49. The bundle gripper 6*f* takes up the bristle bundle 29 in such a manner that the free ends of the bristles terminate flush with the opening 22. This can either be achieved in connection with the removal from the magazine or on pushing the bristle bundle 29 or the bundle gripper 26 onto the stop plate. In this position (FIG. 13*a*), in which the bristle bundle 29 is supported at its rear end by the piston 8, the heater 46 with the heating reflector 48 is moved up to the opening edge 22 and simultaneously the bristle carrier 47 is moved up to the heating piston 49. The free end of the bundle 29 within the bundle gripper 6*f* is melted, as shown at 50. As a result of the sliding of the piston 8, the shortening of the bristles occurring on melting can optionally be compensated. The surface of the bristle carrier 47 is at the same time zonally melted, as indicated at 51. The heating piston 49 is advantageously designed in such a manner that the resulting melt region has an outer outline, which is less than the cross-section of the opening 22 (FIG. 13*b*). Following a short retraction of the bristle carrier 47, the heater 46 is extended and the bundle gripper 6*f* directly placed on the bristle carrier surface, with the opening 22 striking a non-deformable area of the bristle carrier (FIG. 13*b*). As a result the melt is circumferentially trapped and cannot move outwardly. In order to achieve an adequate pressing action in the melt region, the piston 8 can perform a short forward stroke. Optionally, accompanied by the stopping of the piston 8, the bundle gripper 6*f* is retracted and the bristle carrier, for example, a brush shown in FIG. 13*d* is obtained.

Figure 14A:
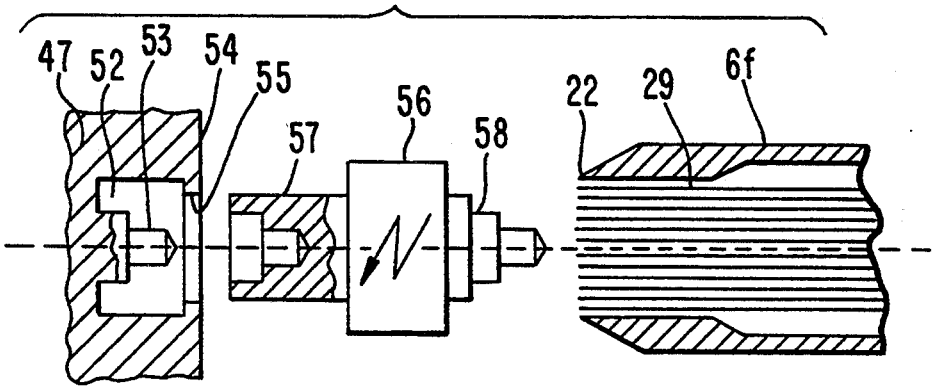
FIGS. 14*a*–14*b* are exploded schematic views of another embodiment of an apparatus constructed in accordance with the present invention in different operating states.
Figure 14B:
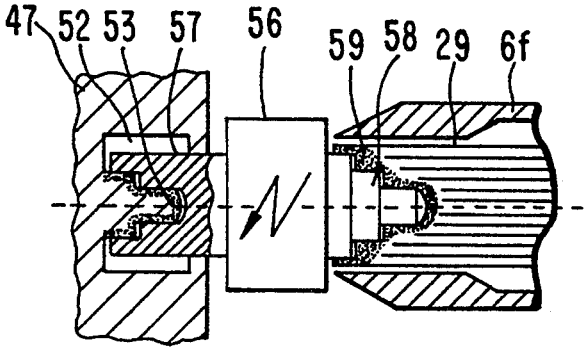
Figure 15:
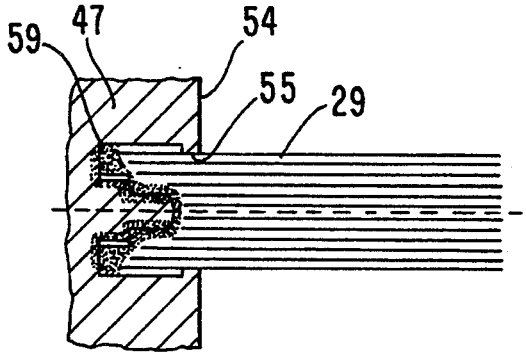
FIG. 15 is a partial cross-sectional view through a bristle article produced in the apparatus of FIGS. 14*a*–14*b;*

In the embodiment according to FIG. 14 the same apparatus components as in FIG. 13 are shown. However, here use is made of a prepared bristle carrier 47, which has a depression 52 for receiving the bristle bundle 29. Within the depression 52 is provided a projection 53, but which does not project up to the free bristle carrier surface 54. The depression 52 also has a constriction 55 on the surface 54 corresponding to the diameter of the bundle 29. In this case the heater 56 has, on the side of the bristle carrier 47 a hollow heating piston 57, whose inner contour substantially corresponds to that of the projection 53. On the side facing the bristle bundle 29, the heater 56 also has a stepped heating piston 58. The heating piston 58 tapers via the steps toward its free end. In this embodiment the bundle gripper 6*f*, the heater 56 and the bristle carrier 47 are moved together in a manner shown in FIG. 14*b*. The heating piston 57 of the heater 56 melts the material of the projection 53 and the bottom of the depression 52, at least in the area near the surface. The bristles of the bundle 29 are melted from the end thereof and an inwardly depressed melt region 59 is produced. After the moving apart and extension of the heater 56, the bristle bundle 29 and the bristle carrier 57 are moved together, the bristle bundle 29 penetrating the depression 52 and the melted region 59 of the bristles is connected to the surface-near melt of the projection 53 or the bottom of the depression 52. Thus, as can be seen in FIG. 15, the connection is located within the bristle carrier 47, so that no changes occur to its free surface 54. In addition, the bristle bundle 29 is laterally supported by the constriction 55.

Figure 16:
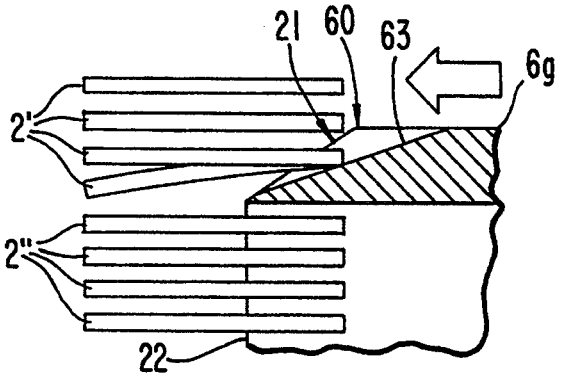
FIG. 16 is an axial partial cross-sectional view of yet another embodiment of a bundle gripper of the apparatus constructed in accordance with the present invention.
Figure 17:
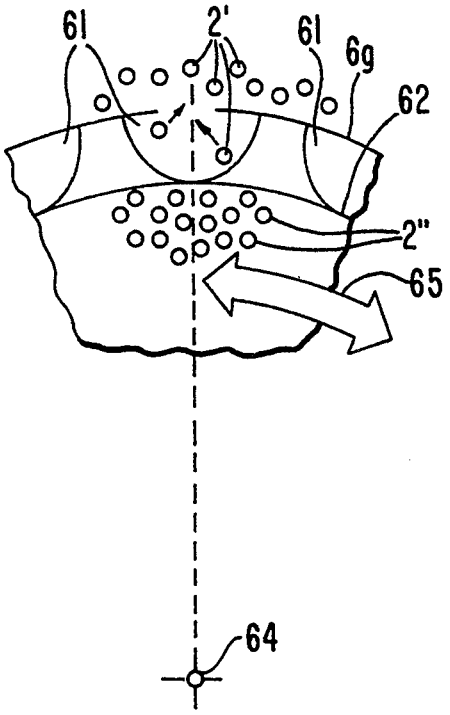
FIG. 17 is an end view of the bundle gripper of FIG. 16.
Figure 18:
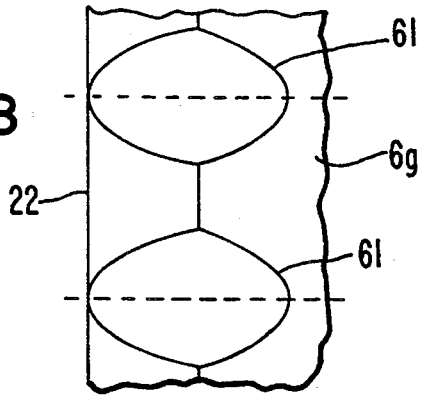
FIG. 18 is a plan view of the gripper of FIG. 16.

FIGS. 16 to 18 show another embodiment of a bundle gripper 6*g* which is cylindrically constructed over most of its axial length and externally, in a vicinity of its end 21, is conically tapered towards the opening 22. At the end 21, the bundle gripper 6*g* also has a profile generally designated by the reference numeral 60 which, in the illustrated embodiment, is formed by troughs 61, which are equidistantly distributed with respect to one another on the circumference. As can be seen in FIG. 17, the troughs 61 have a pitch circular cross-section and the bottom thereof 62 is located on a conical surface 63 (FIG. 16), which has a shallower angle than a conical taper at the bundle gripper end 21. The bottom 62 of the troughs 61 and, therefore, the conical surface 63 pass out at the edge of the opening 22. Upon introduction of the bundle gripper 6*g* into the magazine, the bristles 2' are deflected outwardly, while the bristles 2'' are grasped by the gripper 6*g*.

The bundle gripper 6*g* is rotated about its center axis 64. This can take place uniformly, intermittently or, as indicated by the double arrow 65 in FIG. 17, in an oscillating manner, so that the bristles entering the troughs 61 are exposed to a tangential component, as indicated by the arrows in FIG. 17.

Figure 19:
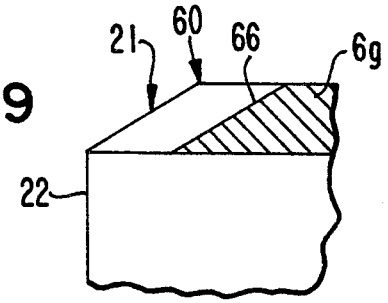
FIG. 19 is a schematic sectional view of a modified embodiment of the bundle gripper of FIG. 16.
Figure 20:
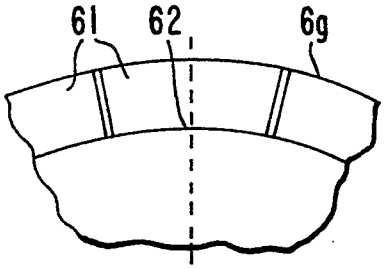
FIG. 20, is an end view of the bundle gripper of FIG. 19.
Figure 21:
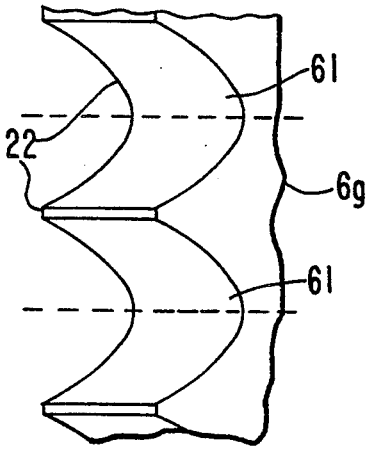
FIG. 21 is a plan view of the bundle gripper of FIG. 19.

In the embodiment according to FIGS. 19 to 21 the bottom of the trough 61 is on a conical surface 66, which is stepper than that of FIG. 16, for example, as the same angle of inclination as the conical taper at the end 21 of the bundle gripper 6*g*. The conical surface 66 penetrates the cylinder formed by the inner wall of the bundle gripper 6*g*, so that the edge of the opening 22 is profiled in a crown-like manner (FIG. 21).

I claim:

1. Apparatus for producing bristle bundles, the apparatus comprising:

a shaft-like magazine for receiving a supply of cut-to-length parallel-positioned bristles; and at least one tubular bundle gripper having an opening with an internal cross-section corresponding to a desired cross-section of the bristle bundle, said bundle gripper being movable into the magazine so as to separate at least one bristle bundle from the bristles in the magazine, and wherein an interior of the bundle gripper widens from the opening in a constant curve portion over a short axial length portion, and, over a substantial remaining portion of an axial length a wall portion of the interior of the bundle gripper extends in parallel to a longitudinal center axis of the tubular bundle gripper such that the tubular bundle gripper has an internal cross-section greater than said opening.

2. Apparatus according o claim 1, wherein the at least one tubular bundle gripper has a further wall portion extending in parallel to the longitudinal center axis of the at least one tubular bundle gripper over a short axial length from an edge of the opening to the constant curve portion.

3. Apparatus for producing bristle bundles according to claim 1, further comprising:

a mandrel disposed along the center axis of the at least one tubular bundle gripper, said mandrel, over a short length in a vicinity of the opening of the at least one tubular bundle gripper, having a portion with an axially parallel contour and a taper at a free end projecting beyond a free end of the at least one tubular bundle gripper.

4. Apparatus according to claim 1, wherein the at least one tubular bundle gripper includes a deflector for bristles in the shaft-like magazine in an area of the opening of the at least one tubular bundle gripper, said deflector being formed by an outer wall of the at least one tubular gripper, said outer wall being formed as a continuous curve up to a maximum wall cross-section and then decreasing to a wall portion disposed in parallel to the center axis of the at least one tubular bundle gripper.

5. Apparatus according to one of claims 1, 2, 3 or 4, wherein the at least one tubular bundle gripper is rotatable about the center axis thereof.

6. Apparatus according to claim 5, wherein the bundle gripper is moved with one of a uniform, intermittent or oscillating rotary movement.

7. Apparatus according to claim 1, wherein a piston disposed in and forming a rear termination of the at least one tubular bundle gripper includes narrow channels connected to a vacuum source.

8. Apparatus according to claim 1, further comprising a piston for ejecting a bristle bundle from the at least one tubular bundle gripper, wherein the piston has a cross-section corresponding to the greater internal cross-section of the at least one tubular bundle gripper, and wherein the piston is displaceable in the at least one tubular bundle gripper in a engaging manner up to a shoulder of the constant curve portion.

9. Apparatus according to claim 8, wherein the piston is guided on a mandrel disposed along the center axis of the at least one tubular bundle gripper for enabling a forming of hollow bristle bundles, said piston being adapted to eject the bristle bundle from the at least one tubular bundle gripper.

10. Apparatus according to claim 9, wherein the at least one tubular bundle gripper and the mandrel have smooth walls on all surfaces contacting the bristles.

11. Apparatus according to claim 10, wherein the at least one bundle gripper serves as a mounting support for the bristle bundle.

12. Apparatus according to claim 14, wherein the at least one tubular bundle gripper is introducible into the magazine from one side and wherein the bristle bundle is moved by the piston to an opposite side of the magazine and into at least one guidance channel of a guide at the opposite side of the magazine.

13. Apparatus according to claim 12, wherein the guide includes a mounting support for the bristle bundle, and wherein the mounting support can be fixed in the guide.

14. Apparatus according to claim 13 wherein the guide includes a clamping device for constricting a cross-section of the at least one guidance channel and for fixing the bristle bundle.

15. Apparatus according to claim 14, wherein the guide includes a plurality of guidance channels which, at least in a vicinity of an outlet end of the bristles, are arranged in an angular manner with respect to one another and in which, upon a transfer of the bristle bundle, the bristle bundle can be deflected into a position corresponding to a desired position on a bristle article.

16. Apparatus according to claim 8, wherein a leading face of the piston has a diverging contour for contouring ends of the bristle bundle.

17. Apparatus according to claim 1, wherein a mandrel is provided along the longitudinal center axis of the at least one tubular bundle gripper for enabling a forming of hollow bristle bundles.

18. Apparatus according to claim 1, wherein the at least one tubular bundle gripper serves as a conveying means for the bristle bundle for the purpose of further processing of the bristle bundle.

19. Apparatus according to claim 1, comprising a plurality of tubular bundle grippers each accommodating a piston for ejecting a bristle bundle from the respective tubular bundle grippers, said pistons being arranged so as to have different end positions in the tubular bundle grippers, whereby the bristle bundles are inserted by a correspondingly varying distance into a guidance channel, so that bristle bundles of different lengths are obtained on a bristle article.

20. Apparatus according to claim 1, wherein the bristle bundles are inserted to a varying extent into a first guide by a piston of the at least one tubular bundle gripper and accompanied by a formation of a projecting length of bristle ends at an opposite side of the piston, wherein the projecting length of the bristle ends is cut off and, at a position upstream of a cutting point, can be introduced into a further guide with guidance channels inclined with respect to one another at least at the opposite side.

21. Apparatus according to claim 20, wherein ends of the bristle bundle facing the pistons are slid through the guidance channels and fixed by the projecting lengths of the bristles to a bristle carrier.

22. Apparatus according to claim 20, wherein, following the movement of the at least one tubular bundle gripper into the magazine and prior to the moving out of the bristle bundle by the piston, the guide is insertable in front of the opening of the at least one tubular gripper.

23. Apparatus according to claim 1, wherein a bottom terminating a lower end of the magazine is adapted to be vibrated so as to loosen at least a part of the bristles in the magazine.

24. Apparatus according to claim 23, wherein one wall of the magazine at least in an area subject to action of the at least one tubular bundle gripper has at least one portion vibratable in an axial direction of the bristles, and wherein the vibratable wall portion is positioned in parallel to a facing wall of the magazine at a distance therefrom which is greater in each vibrating position than a length of the bristles located in the magazine.

25. Apparatus according to claim 24, wherein the at least one vibratable wall portion is associated with adjustable stops for maintaining a spacing relative to the facing wall.

26. Apparatus according to claim 1 wherein a separator is insertable into the magazine at right angles to the bristles and from above the at least one tubular bundle gripper so as to absorb the weight of the supply of the bristles located in the magazine above the at least one tubular bundle gripper.

27. Apparatus according to claim 26, wherein, in the inserted position, the separator is adapted to be raised at least during the movement of the at least one tubular bundle gripper into the magazine.

28. Apparatus for producing bristle bundles, the apparatus comprising:

a shaft-like magazine for receiving a supply of cut-to-length parallel-positioned bristles; and at least one tubular bundle gripper having an opening with an internal cross-section corresponding to a desired cross-section of the bristle bundle, said bundle gripper being movable into the magazine so as to separate at least one bristle bundle from the bristle supply, wherein the bundle gripper has an axially oriented external profile over a short length thereof in a vicinity of the opening, and wherein the external profile includes troughs arranged equidistantly along a circumference of the at least one tubular bundle gripper.

29. Apparatus according to claim 7, wherein the troughs have a pitch circular cross-section.

30. Apparatus according to claim 28, wherein the troughs are arranged so as to extend to a circular edge of the opening.

31. Apparatus according to claim 28, wherein a bottom of the troughs is located on a conical surface tapering towards the opening.

32. Apparatus according to claim 31, wherein the conical surface passes through a cylindrical surface formed by the opening so that an edge of the opening has a crown-like construction.

* * * * *